US006739835B2

(12) United States Patent
Kim

(10) Patent No.: US 6,739,835 B2
(45) Date of Patent: May 25, 2004

(54) BLADE PART IN TURBOFAN

(75) Inventor: Seong Chun Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 182 days.

(21) Appl. No.: 10/042,251

(22) Filed: Jan. 11, 2002

(65) Prior Publication Data

US 2003/0044281 A1 Mar. 6, 2003

(30) Foreign Application Priority Data

Aug. 24, 2001 (KR) ..... 2001-51428
Aug. 24, 2001 (KR) ..... 2001-51430

(51) Int. Cl.[7] ..... F04D 29/30

(52) U.S. Cl. ..... 416/186 R; 416/223 B; 416/228; 416/236 R; 416/243; 416/DIG. 2

(58) Field of Search ..... 416/185, 186 R, 416/223 R, 223 B, 243, DIG. 2, DIG. 5, 228, 235, 236 R, 236 A

(56) References Cited

U.S. PATENT DOCUMENTS 3,140,042 A * 7/1964 Fuji ..... 416/186 R
3,964,841 A * 6/1976 Strycek ..... 416/186 R
4,526,506 A * 7/1985 Koger et al. ..... 416/185
5,586,053 A * 12/1996 Park ..... 416/DIG. 2
5,588,804 A * 12/1996 Neely et al. ..... 416/223 R
6,206,641 B1 * 3/2001 Park et al. ..... 416/223 R

* cited by examiner

*Primary Examiner*—Christopher Verdier
(74) *Attorney, Agent, or Firm*—Birch, Stewart, Kolasch & Birch, LLP

(57) ABSTRACT

A blade part in a turbofan includes a hub coupled with a rotating axis of a driving part, a plurality of blades arranged radially at a circumferential part of the hub, and a shroud coupled with a plurality of the blades and arranged so as to confront the hub wherein the blades lie between the hub and the shroud, and wherein each of the blades form an airfoil constructed with a top camber line defined by an NACA 4-digit airfoil and a bottom camber line lying closer to the top camber line than a bottom camber line defined by the NACA 4-digit airfoil.

10 Claims, 4 Drawing Sheets

FIG. 9

| FAN | POWER CONSUMPTION (W) | RPM | FLOW RATE | NOISE |
|---|---|---|---|---|
| PRIOR ART (T) | 100.2 | 844 | 18.5 | 46.8 |
| EXAMPLE 1 (0.75T) | 102.6 | 823 | 18.5 | 47.1 |
| EXAMPLE 1 (0.5T) | 103.5 | 810 | 18.5 | 47.6 |
| EXAMPLE 2 (0.5T) | 102 | 815 | 18.5 | 46.6 |

BLADE PART IN TURBOFAN

BACKGROUND OF THE INVENTION

1. Field of the Invention

The present invention relates to a turbofan, and more particularly, to a blade part in a turbofan.

2. Background of the Related Art

Generally, a, blowing fan is used for forcibly driving air by a turning force of an impeller or a rotor, thereby making the blower applicable to a refrigerator, an air conditioner, a vacuum cleaner and the like.

Specifically, blowing fans include an axial fan, a Sirocco fan, a turbo fan, and the like in accordance with methods of driving air according to their respective shapes.

The turbo fan directs air from an axial direction of a fan and drives out the air through the gaps of the impeller, i.e., a lateral side of the fan radially. As air is naturally generated from inside the fan and flows out, the turbo fan requires no duct making it suitable for appliances of large capacity such as a ceiling type air conditioner or similar appliances.

FIG. 1 illustrates a layout of a general turbofan, and FIG. 2 illustrates a vertical cross-sectional view of the general turbofan in FIG. 1.

Referring to FIG. 1 and FIG. 2, a turbofan 1 according to a related art includes a shroud 4, a hub 2 coupled with a driving part 5, and a plurality of blades 3, each blade having one end coupled with the shroud 4, arranged at a circumferential part of the hub 2.

An inlet 7 to draw air inside is formed at an upper part of the turbofan 1. A plurality of flow paths 6 are formed at a central part of the turbofan 1 so as to direct the air drawn through the inlet 7. A plurality of outlets 8 are formed at a lateral side of the turbofan 1 so as to discharge the air.

The above-constructed turbofan according to the related art operates as follows. Once the turbofan 1 is rotated by a driving device, air is drawn in through the inlet 7 by the revolution of the blades. The air drawn through the inlet 7 flows out toward the outlets 8 along the flow paths 6.

FIG. 3 illustrates a cross-sectional view of the blade of the turbofan in FIG. 1.

Referring to FIG. 3, a cross-sectional shape of the blade 3 in the turbofan according to the related art forms an airfoil figure such as an NACA four digit airfoil or the like so as to provide an excellent aerodynamic characteristic. The airfoil configuration has great influence on the performance of the turbofan in power consumption, noise, and the like.

Specifically, time and cost of production depends greatly on the thickness of the blades of the turbofan according to the related art. If a cross-section of the blade is too thick, the cost of production increases. Also, the time required for manufacturing the turbofan by injection molding increases.

SUMMARY OF THE INVENTION

Accordingly, the present invention is directed to a blade part in a turbofan that substantially obviates one or more problems due to limitations and disadvantages of the related art.

An object of the present invention is to provide a blade part in a turbofan enabling to reduce thickness and cost of product of the turbofan.

Additional advantages, objects, and features of the invention will be set forth in part in the description which follows and in part will become apparent to those having ordinary skill in the art upon examination of the following, or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a blade part in a turbofan includes a hub coupled with a rotating axis of a driving part, a plurality of blades arranged radially at a circumferential part of the hub, and a shroud coupled with a plurality of the blades and arranged so as to confront the hub wherein the blades lie between the hub and the shroud, and wherein each of the blades form an airfoil constructed with a top camber line defined by an NACA 4-digit airfoil and a bottom camber line lying closer to the top camber line than a bottom camber line defined by the NACA 4-digit airfoil.

In another aspect of the present invention, a blade part in a turbofan includes a hub coupled with a rotating axis of a driving part, a plurality of blades arranged radially at a circumferential part of the hub, and a shroud coupled with a plurality of the blades and arranged so as to confront the hub wherein the blades lie between the hub and the shroud, and wherein each cross-section of the blades is defined by NACA four digits, i.e., MPXX, so as to form an airfoil, wherein, if a chord line is an X-axis and a leading edge is an origin, and a chord c is 1, x is a chordwise, i.e., X-axis direction, relative coordinate and $y_t(x)$ is a thickness function so as to satisfy $$y_t(x) = \frac{tc}{0.2}(0.2969\sqrt{x} - 0.126x - 0.3516x^2 + 0.3100x^3 - 0.1015x^4),$$

wherein $y_c(x)$ is a Y-axis relative coordinate of a mean camber line and θ is a slope of the mean camber line so as to satisfy $$0 \le x < P,\ \ y_c(x) = \frac{M}{p^2}(2Px - x^2),\ \theta = \tan^{-1}\left\{\frac{2M}{p^2}(P - x)\right\},$$

$$P \le x \le 1,\ \ y_c(x) = \frac{M}{(1-P)^2}(1 - 2P + 2Px - x^2),$$

$$\theta = \tan^{-1}\left\{\frac{2M}{(1-P)^2}(P - x)\right\},$$

and wherein a coordinate $(x_u, y_u)$ of the top camber line of the blade is defined by $x_u = x - y_t(x)\sin\theta$, $y_u = y_c(x) + y_{t(x)}\cos\theta$ and a coordinate $(x_l, y_l)$ of the bottom camber line satisfies $x_l = x + y_t(x)\sin\theta$, $y_{t(x)-yt(x)}\cos\theta < y_l(x) < y_u(x)$.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention.

In the drawings:

FIG. 9 illustrates a table of performance comparison between the turbofans of the related art and the present invention.

DETAILED DESCRIPTION OF THE INVENTION

Reference will now be made in detail to the preferred embodiments of the present invention, examples of which are illustrated in the accompanying drawings.

Figure 1:
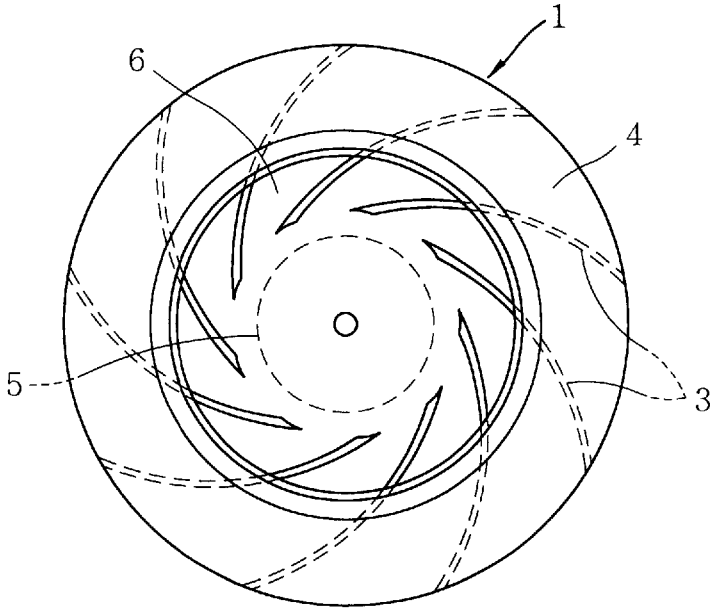
FIG. 1 CONVENTIONAL ART
FIG. 1 illustrates a layout of a general turbofan.
Figure 2:
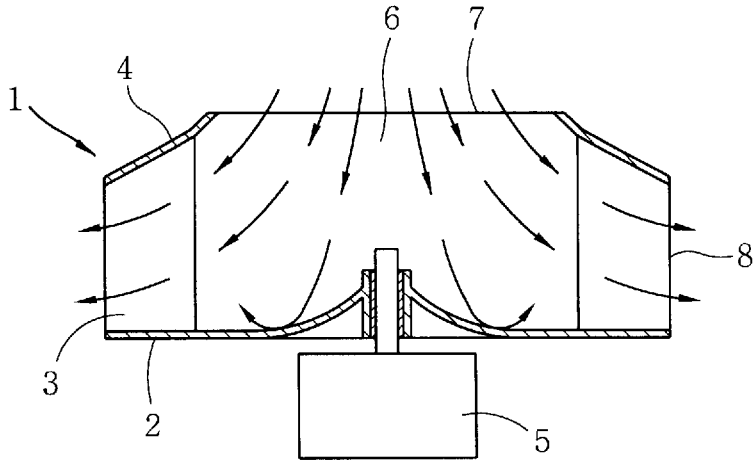
FIG. 2 CONVENTIONAL ART
FIG. 2 illustrates a vertical cross-sectional view of the general turbofan in FIG. 1.
Figure 3:
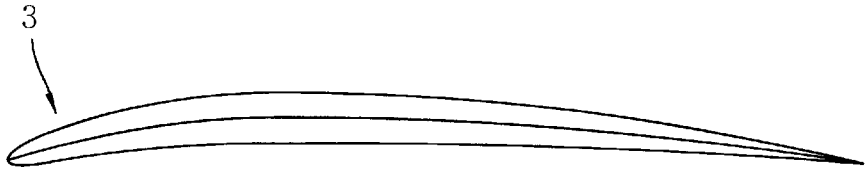
FIG. 3 CONVENTIONAL ART
FIG. 3 illustrates a cross-sectional view of the blade of the turbofan in FIG. 1.
Figure 4:
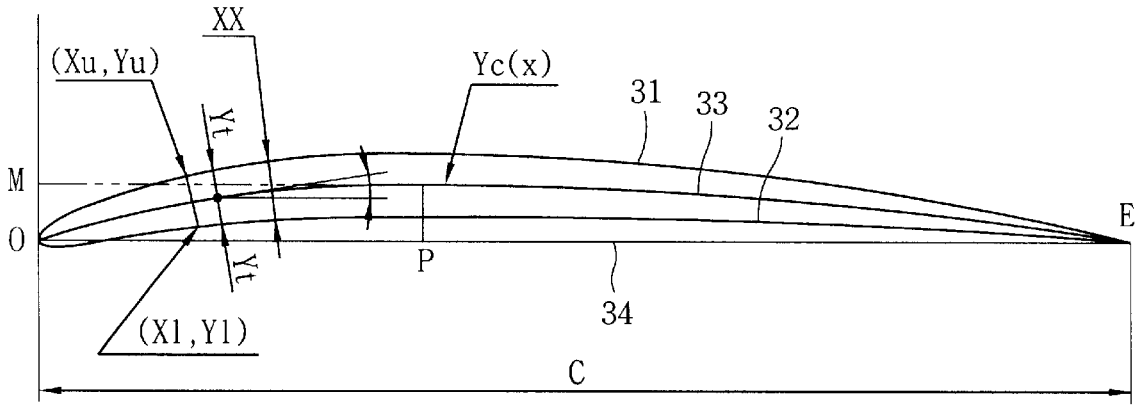
FIG. 4 CONVENTIONAL ART
FIG. 4 illustrates a schematic cross-sectional view of a general NACA four-digit airfoil.
Figure 5:
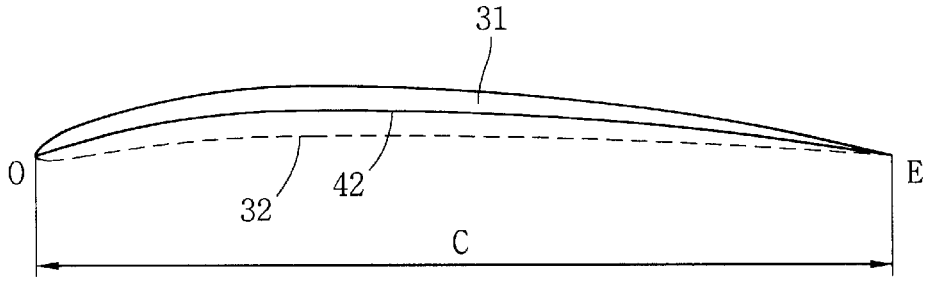
FIG. 5 illustrates a cross-sectional view of a blade in a turbofan according to a first embodiment of the present invention.

FIG. 4 illustrates a schematic cross-sectional view of a general NACA four-digit airfoil, and FIG. 5 illustrates a cross-sectional view of a blade in a turbofan according to a first embodiment of the present invention.

Referring to FIG. 4, a shape of a general NACA 4-digit airfoil depends on a top camber line 31 and a bottom camber line 32. The top and bottom camber lines 31 and 32 are defined as follows(hereinafter, it is assumed that a chord line 34 c is 1).

When an airfoil is NACA MPXX, a coordinate $(x_u, y_u)$ is defined by the following Formula 1 if the chord line 34, a line perpendicular to the chord line 34, and a leading edge O are an X-axis, a Y-axis, and an origin, respectively.

$$x_u = x - y_t(x)\sin\theta,\ y_u = y_c(x) + y_{t(x)}\cos\theta, \quad \text{[Formula 1]}$$

where x is an X coordinate, $y_c(x)$ is an Y coordinate of a mean camber line 33, $y_t(x)$ is a thickness function, and θ is a slope of the mean camber line 33.

$Y_t(x)$, $y_c(x)$, and θ are defined by the following Formula 2 and Formula 3.

$$y_t(x) = \frac{tc}{0.2}\left(0.2969\sqrt{x} - 0.126x - 0.3516x^2 + 0.3100x^3 - 0.1015x^4\right) \quad \text{[Formula 2]}$$

$$0 \le x < P,\quad y_c(x) = \frac{M}{P^2}(2Px - x^2),$$
$$\theta = \tan^{-1}\left\{\frac{2M}{P^2}(P - x)\right\} \quad \text{[Formula 3]}$$
$$P \le x \le 1,\quad y_c(x) = \frac{M}{(1-P)^2}(1 - 2P + 2Px - x^2),$$
$$\theta = \tan^{-1}\left\{\frac{2M}{(1-P)^2}(P - x)\right\},$$

where M is a % value of a relative y coordinate of a maximum camber and P is a 10% value of a relative x coordinate of the maximum camber.

A coordinate$(x_t, y_t)$ of the bottom camber line 32 of the airfoil is defined by the following Formula 4.

$$x_t = x + y_t(x)\sin\theta,\ y_t = y_c(x) - y_{t(x)}\cos\theta \quad \text{[Formula 4]}$$

Meanwhile, as shown in FIG. 5, a shape of a blade of a turbofan according to a first embodiment of the present invention depends on a top camber line 31 and a bottom camber line 42 of a cross-section thereof. The top and bottom camber lines 31 and 42 are defined by the following Formula 5 and Formula 6.

$$x_u = x - y_t(x)\sin\theta,\ y_u = y_c(x) + y_{t(x)}\cos\theta \quad \text{[Formula 5]}$$
$$x_t = x + y_t(x)\sin\theta,\ y_c(x) - y_{t(x)}\cos\theta < y_u(x) < y_u(x) \quad \text{[Formula 6]}$$

Namely, the bottom camber line 42 of the blade cross-section is formed closer to the top camber line 31 than bottom camber line 32 of the NACA 4-digit airfoil. Therefore, the present invention reduces a thickness of the airfoil forming the cross-sectional shape of the blade in the turbofan. In this case, the correct thickness of the blade cross-section formed by the top and bottom camber lines 31 and 42 is determined by considering factors such as structural strength and the product possibility and the like required by the specification of the turbofan blade. In the embodiment of the present invention, it is experimented with 1, 0.75, 0.5, etc. For instance, the bottom camber line 42 may take an averaged camber line(i.e., $y_t(x) = y_c(x)$).

Figure 6:
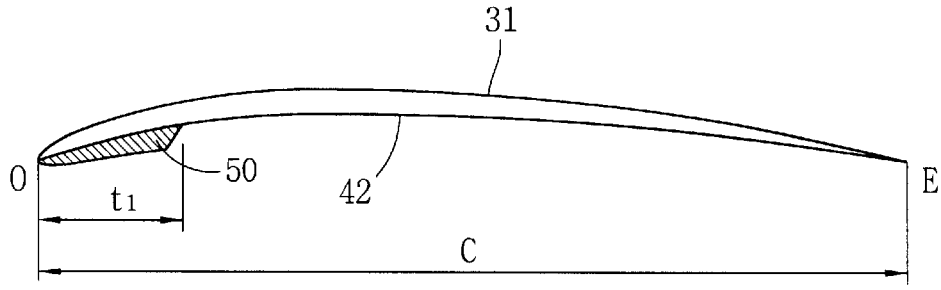
FIG. 6 illustrates a cross-sectional view of a blade in a turbofan according to a second embodiment of the present invention.
Figure 7:
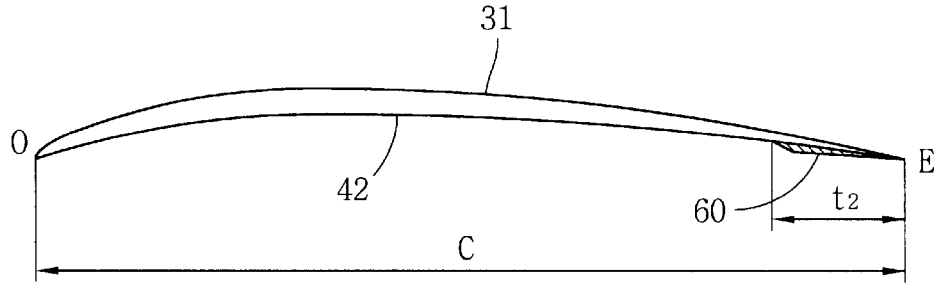
FIG. 7 illustrates a cross-sectional view of a blade in a turbofan according to a third embodiment of the present invention.
Figure 8:
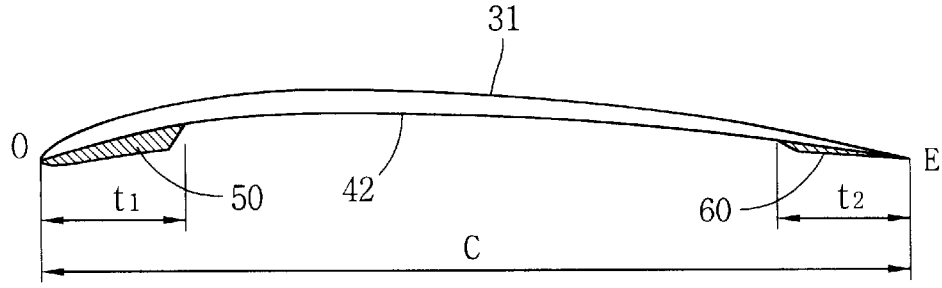
FIG. 8 illustrates a cross-sectional view of a blade in a turbofan according to a third embodiment of the present invention.

FIG. 6 illustrates a cross-sectional view of a blade in a turbofan according to a second embodiment of the present invention, FIG. 7 illustrates a cross-sectional view of a blade in a turbofan according to a third embodiment of the present invention, and FIG. 8 illustrates a cross-sectional view of a blade in a turbofan according to a third embodiment of the present invention.

In order to strengthen the aerodynamic characteristic of the airfoil forming the blade cross-section according to a variable bottom camber line, the present invention includes a turbulence preventing apparatus enabling to improve the aerodynamic characteristic thereof.

Referring to FIG. 6, in order to prevent the disadvantage generated from changing the shape of the NACA 4-digit airfoil, a blade according to a second embodiment of the present invention includes a first turbulence preventing part 50 added to a part adjacent to a leading edge O of the blade cross-section of the turbofan of the first embodiment of the present invention. The turbulence preventing part 50, as a turbulence preventing apparatus, has a coordinate $(x_{p1}, Y_{p1})$ defined by the following Formula 7.

$$x_{p1} = x + y_t(x)\sin\theta,\ y_t(x) < y_{p1}(x) \quad \text{[Formula 7]}$$

The first turbulence preventing part 50 makes the blade cross-section thinner than the blade cross-section of the turbofan of the first embodiment of the present invention but forms a portion, near the leading edge O, thicker than the blade cross-section of the turbofan of the first embodiment of the present invention. Therefore, the second embodiment of the present invention suppresses turbulence so as to improve the aerodynamic characteristic of the blade in the turbofan.

Specifically, the first turbulence preventing part 50 may be formed to be equivalent to the bottom camber line 32 of the NACA 4-digit camber line 32. In other words, the first turbulence preventing part 50 can have the coordinate $(x_{p1}, Y_{p1})$ satisfying $x_{p1} = x + y_t \sin\theta$, $y_{p1} = y_c(x) - y_t \cos\theta$. The first turbulence preventing part 50 is preferably formed at a portion $t_1$ within a distance under 0.4c(c is a chord) from the leading edge O. Namely, $t_1$ is preferably formed at $0 < t_1 23.4$.

Referring to FIG. 7, a blade in a turbofan according to a third embodiment of the present invention includes a second turbulence preventing part 60 added to a part adjacent to a trailing edge E of the blade cross-section of the turbofan of the first embodiment of the present invention. The second turbulence preventing part 60 as a turbulence preventing apparatus has a coordinate ($p_{p2}$, $Y_{p2}$) defined by the following Formula 8.

$$x_{p2}=x+y_t(x)\sin\theta,\ y_t(x)<y_{p2}(x) \quad \text{[Formula 8]}$$

The second turbulence preventing part 60 makes the blade cross-section thinner than the blade cross-section of the turbofan of the first embodiment of the present invention but forms a portion, near the trailing edge E, thicker than that of the turbofan of the first embodiment of the present invention. Therefore, the third embodiment of the present invention suppresses turbulence so as to improve the aerodynamic characteristic of the blade in the turbofan.

Specifically, the second turbulence preventing part 60 may be formed to be equivalent to the bottom camber line 32 of the NACA 4-digit camber line 32. In other words, the second turbulence preventing part 60 can have the coordinate ($x_2$, $x_{p2}$) satisfying $x_{p2}=x+y_t \sin\theta$, $Y_{p2}=y_t(x)-y_t \cos\theta$. The second turbulence preventing part 60 is preferably formed between a portion $t_2$ having at least 0.6c(c is a chord) and the trailing edge E. Namely, $t_2$ is preferably formed at $0.6<t_2\leqq 1.0$.

A blade in a turbofan according to a fourth embodiment of the present invention, as shown in FIG. 8, includes the second and first turbulence preventing parts 60 and 50 added to the blade cross-section of the turbofan of the first embodiment of the present invention.

Besides, the first and second turbulence preventing parts 50 and 60 may have coordinates defined by the same formulas in the second and third embodiments of the present invention. For instance, ($x_{p1}$, $y_{p1}$) and ($x_{p2,\ yp2}$) are defined by $x_{p1}=x+y_t \sin\theta$, $y_{p1}=y_c(x)-y_1 \cos\theta$ and $x_{p2}=x+y_t \sin\theta$, $y_{p2}=y_c(x)-y_t \cos\theta$, respectively. For example, $X_{p2}=x_{p1}$ and $y_{p2}(x)<y_{p1}(x)$.

Specifically, the first turbulence preventing part 50 is formed at a portion $t_1$ within a distance under 0.4c(c is a chord) from the leading edge O. Namely, $t_1$ is preferably formed at $0<t_1\leqq 0.4$. The second turbulence preventing part 60 is preferably formed between a portion $t_2$ having at least 0.6c(c is a chord) and the trailing edge E. Namely, $t_2$ is preferably formed at $0.6<t_2 1.5$.

FIG. 9 illustrates a table of performance comparison between the turbofans of the related art and the present invention.

Referring to FIG. 9, comparing the turbofan of the related art to that of the present invention in aspect of performance, the present invention increases power consumption and noise slightly at the same airflow.

In spite of the minor decrease of aerodynamic characteristic, the turbofan having blades according to the present invention makes the blade cross-section thinner in order to reduce raw material for manufacturing the turbofan, thereby enabling reduction of costs and reduction in time of production. Namely, the blade structure of the turbofan according to the present invention reduces the raw material required for manufacturing the turbofan without greatly degrading the performance of the turbofan, thereby enabling reduction of the costs of production. Besides, the present invention reduces the process time of manufacturing the turbofan by decreasing the thickness, thereby enabling an increase in productivity. Particularly, the blade according to the second embodiment of the present invention, as shown in FIG. 9, decreases noise.

The forgoing embodiments are merely exemplary and are not to be construed as limiting the present invention. The present teachings can be readily applied to other types of apparatuses. The description of the present invention is intended to be illustrative, and not, to limit the scope of the claims. Many alternatives, modifications, and variations will be apparent to those skilled in the art.

What is claimed is:

1. A blade part in a turbofan, comprising:

a hub coupled with a rotating axis of a driving part;

a plurality of blades arranged radially at a circumferential part of the hub; and a shroud coupled with a plurality of the blades and arranged so as to confront the hub wherein the blades lie between the hub and the shroud, and wherein each cross-section of the blades is defined by NACA four digits, so as to form an airfoil wherein, if a chord line is an X-axis and a leading edge in an origin, and a chord c is 1, x is a chordwise, X-axis direction, relative coordinate and $y_t(x)$ is a thickness function so as to satisfy $$y_t(x)=\frac{tc}{0.2}(0.2969\sqrt{x}-0.126x-0.3516x^2+0.3100x^3-0.1015x^4),$$

wherein $Y_c(x)$ is a Y-axis relative coordinate of a mean camber line and θ is a slope of the mean camber line so as to satisfy $$0\le x<P,\ \ y_c(x)=\frac{M}{p^2}(2Px-x^2),\ \theta=\tan^{-1}\left\{\frac{2M}{P^2}(P-x)\right\},$$

$$P\le x\le 1,\ \ y_c(x)=\frac{M}{(1-P)^2}(1-2P+2Px-x^2),$$

$$\theta=\tan^{-1}\left\{\frac{2M}{(1-P)^2}(P-x)\right\},$$

where M is a % value of a relative y coordinate of a maximum camber and P is a 10% value of a relative x coordinate of the maximum camber and wherein a coordinate ($x_u$,$y_u$) of the top camber line of the blade is defined by $x_u=x-y_t(x)\sin\theta$, $y_u=y_c(x)+y_{t(x)}\cos\theta$ and a coordinate ($x_l$,$y_l$) of the bottom camber line satisfies $x_l=x+y_t(x)\sin\theta$, $y_c(x)-y_{t(x)}\cos\theta<y_l(x)<y_u(x)$ such that each of the blades form an airfoil constructed with a top camber line defined by a NACA 4-digit airfoil and a bottom camber line lying closer to the top camber line than a bottom camber line defined by the NACA 4-digit airfoil.

2. A blade part in a turbofan, comprising:

a hub coupled with a rotating axis of a driving part;

a plurality of blades arranged radially at a circumferential part of the hub; and a shroud coupled with a plurality of the blades and arranged so as to confront the hub wherein the blades lie between the hub and the shroud, and wherein each cross-section of the blades is defined by NACA four digits, so as to form an airfoil wherein, if a chord line is an X-axis and a leading edge is an origin, and a chord c is 1, x is a chordwise, X-axis direction, relative coordinate and $y_t(x)$ is a thickness function so as to satisfy $$y_t(x) = \frac{tc}{0.2}\left(0.2969\sqrt{x} - 0.126x - 0.3516x^2 + 0.3100x^3 - 0.1015x^4\right),$$

wherein $y_c(x)$ is a Y-axis relative coordinate of a mean camber line and θ is a slope of the mean camber line so as to satisfy $$0 \le x < P,\quad y_c(x) = \frac{M}{P^2}(2Px - x^2),\ \theta = \tan^{-1}\left\{\frac{2M}{P^2}(P - x)\right\},$$

$$P \le x \le 1,\quad y_c(x) = \frac{M}{(1-P)^2}(1 - 2P + 2Px - x^2),$$

$$\theta = \tan^{-1}\left\{\frac{2M}{(1-P)^2}(P - x)\right\},$$

where M is a % of a relative y coordinate of a maximum camber and P is a 10% value of a relative x coordinate of the maximum camber, and wherein a coordinate $(x_u, y_u)$ of the top camber line of the blade is defined by $x_u = x - y_t(x)\sin\theta$, $y_u = y_c(x) + y_{t(x)}\cos\theta$ and a coordinate $(x_l, y_l)$ of the bottom camber line satisfies $x_l = x + y_t(x)\sin\theta$, $y_c(x) - y_{t(x)}\cos\theta < y_{l(x)<yu}(x)$.

3. The blade part of claim 2, further comprising a first turbulence preventing part at a portion near the leading edge of the blade cross-section in accordance with a coordinate $(x_{p2}, y_{p1})$ satisfying $x_{p1} = x + y_t(x)\sin\theta$, $y_t(x) < y_{p1}(x)$.

4. The blade part of claim 3, wherein the first turbulence preventing part is formed chordwise at a portion within $0 \leqq X_{p1} \leqq t_1$, where $0 \leqq t_1 \leqq 0.4$.

5. The blade part of claim 3, wherein $y_{p1} = y_c(x) - y_t\cos\theta$.

6. The blade part of claim 3, further comprising a second turbulence preventing part at a portion near a trailing edge of the blade cross-section in accordance with a coordinate $(X_{p2}, y_{p2})$ satisfying $x_{p2} = x + y_t(x)\sin\theta$, $y_t(x) < y_{p2}(x)$.

7. The blade part of claim 6, wherein the second turbulence preventing part is formed at a portion within $t_2 \leqq x_{p2} \leqq 1$, where $0.6 \leqq t_2 \leqq 1.0$.

8. The blade part of claim 6, wherein $y_{p2} = y_c(x) - y_t\cos\theta$.

9. The blade part of claim 6, wherein $x_{p2} = x_{p1}$ and $y_{p2}(x) < y_{p1}(x)$.

10. The blade part of claim 2, wherein $y_t(x) = y_c(x)$.

* * * * *